United States Patent [19]

Smith

[11] 4,008,941

[45] Feb. 22, 1977

[54] PRINTED CIRCUIT BOARD HOUSING SYSTEM

[75] Inventor: Donald Lee Smith, Middletown, Pa.

[73] Assignee: AMP Incorporated, Harrisburg, Pa.

[22] Filed: Mar. 4, 1976

[21] Appl. No.: 663,649

[52] U.S. Cl. ..... 339/91 P; 339/17 LC; 339/176 MP

[51] Int. Cl.[2] ..... H01R 17/06; H01R 27/02

[58] Field of Search ..... 339/17 L, 17 LC, 75 R, 339/75 M, 176 MP, 176 M, 91 R, 91 P

[56] References Cited

UNITED STATES PATENTS

| | | | |
|---|---|---|---|
| 3,434,098 | 3/1969 | Schumacher | 339/91 R |
| 3,958,852 | 5/1976 | Abraham et al. | 339/176 MP X |

FOREIGN PATENTS OR APPLICATIONS

| | | | |
|---|---|---|---|
| 202,381 | 3/1966 | Sweden | 339/91 P |

*Primary Examiner*—W. Tupman
*Assistant Examiner*—E. F. Desmond
*Attorney, Agent, or Firm*—Allan B. Osborne

[57] ABSTRACT

The present invention relates to a housing system adapted to connect single or twin coaxial cable to a printed circuit board. More particularly the invention provides one housing having contact pins therein which is attached to the board by soldering or insertion into spring socket members. The invention further provides a second housing latchable to the first and adapted to carry terminals which plug into the contacts.

4 Claims, 4 Drawing Figures

PRINTED CIRCUIT BOARD HOUSING SYSTEM

BACKGROUND OF THE INVENTION

1. Field of the Invention

This invention is in the art of connecting single or twin coaxial cable to a printed circuit board and the housings associated therewith.

2. Prior Art

Hereto before, single or twin coaxial cable terminals were attached individually to circuits on printed circuit boards with the result that the operation was expensive, time consuming and required a considerable amount of space. Further, the pins to which the cable terminals plugged into had to be positioned and secured to the board one-by-one.

SUMMARY OF THE PRESENT INVENTION

The present invention is an assembly comprising a first and second housing. The first housing contains a plurality of sets of right angle pins which are fixed to a printed circuit board by soldering or by insertion into spring sockets. Each set of pins include either one signal pin and one ground pin or two signal pins and one ground pin. In either case, each pin is horizontally spaced to provide a space saving package. The second housing which latches onto the first, contains a plurality of passageways to receive and retain the coaxial cable terminals.

DESCRIPTION OF THE PRESENT INVENTION

Figure 1:
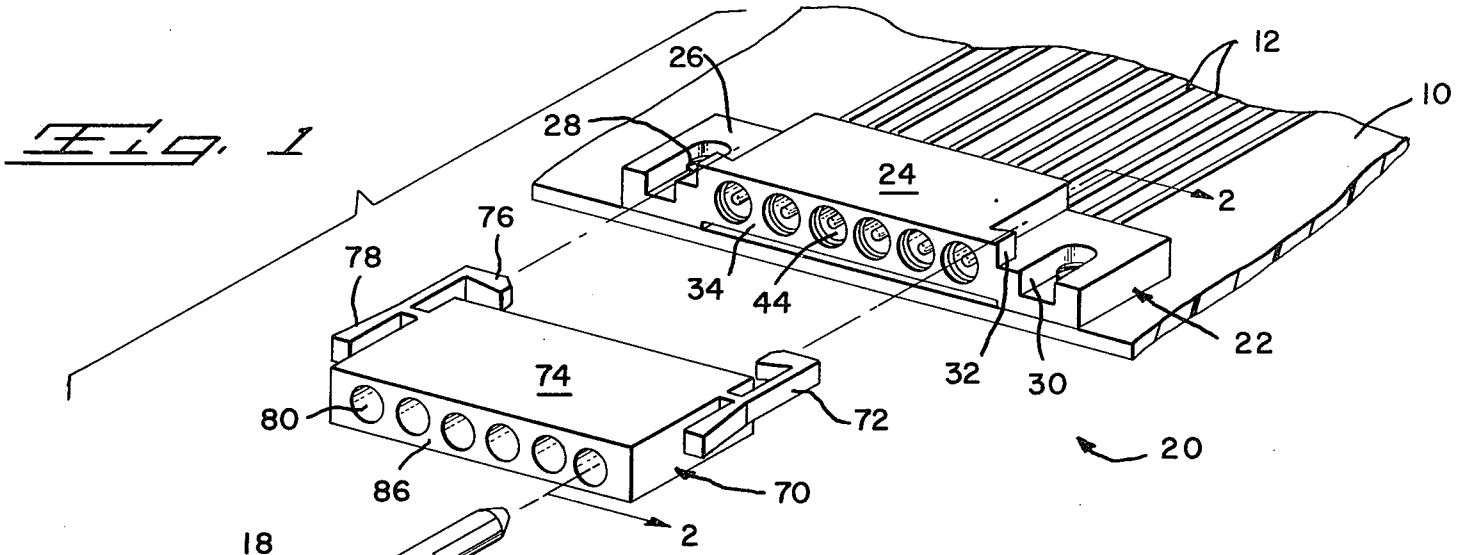
FIG. 1 is a perspective view of the housing system constructed in accordance with the present invention.
Figure 2:
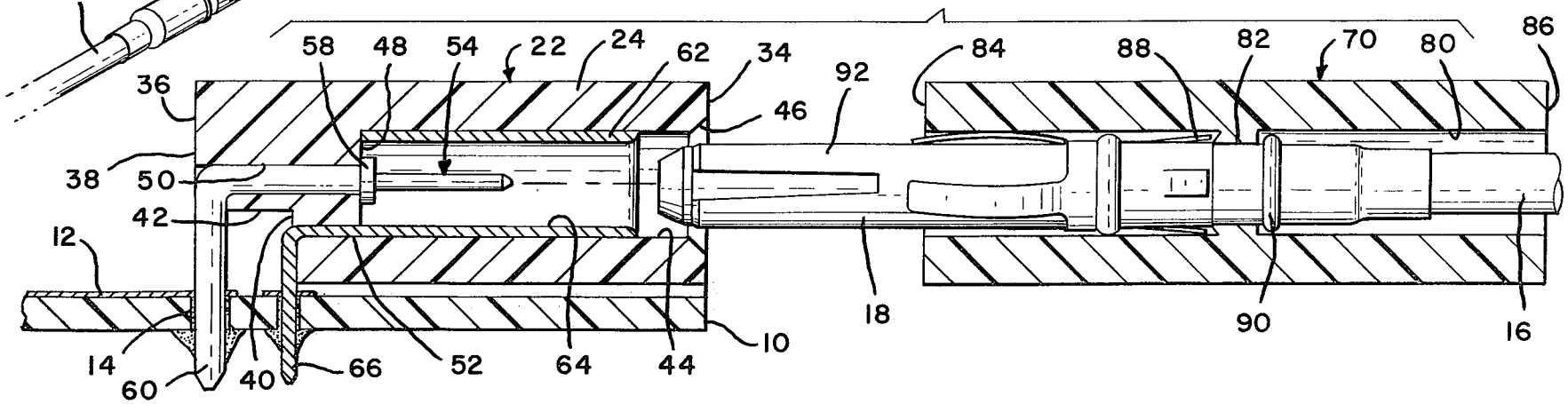
FIG. 2 is an elevational, cross-sectional view of the system taken along lines 2—2 of FIG. 1.

Reference numeral 10 indicates a printed circuit board having a plurality of conductive traces or circuits 12 deposited thereon. Each circuit is connected to an opening 14 (FIG. 2).

Reference numerals 16 and 18 indicate a coaxial cable and a hooded female terminal respectively to which the cable is connected by crimping.

The housing system of the present invention, indicated generally by reference numeral 20, provides a means for compactly and economically removably interconnecting cable 16 to a circuit 12 on board 10.

System 20 includes a first housing 22 molded from nylon or other suitable insulating material. Housing 22 has a body section 24 which is bounded on either side by attachment means or wings 26. Apertures 28 in the wings may be used to fasten the first housing to board 10 by bolts (not shown) or the like. The slots 30 in the wings enable the fastening means to be recessed and thus out of the way from accidental shorting. A pair of ears 32 are provided, one on either side of the body section and on its front face 34. These ears provide complementary latching means and will be discussed further with respect to the second housing 70. The rear face 36 of the body section is undercut to provide a first and second vertical walls 38 and 40 respectively and a downwardly facing horizontal wall 42.

A plurality of circular cavities 44, arranged in a row from one side to the other, extend from the front face into the body section for a predetermined depth. The entrance 46 to each cavity is beveled to guide insertion of a terminal 18. The rear wall 48 of each cavity has openings for two passages 50 and 52. Passage 50 is centrally located in the cavity rear wall and opens out on the first vertical wall 38 and horizontal wall 42. Passage 52 extends from the bottom of the cavity rear wall to the second vertical wall 40.

A signal contact pin 54 is staked into passage 50 in each cavity. This pin has a forward mating section 56, positioning means or collar 58 and a heavy, elongated leg 60. The tip of leg 60 may be beveled as shown to facilitate its insertion into an opening 14 on board 10. Preferably contact pin 54 is made from brass.

A ground contact pin 62 has a sleeve 64 and an elongated leg 66. This pin fits into cavity 44 with the sleeve lining the wall and leg 66 passing out through passage 52. This contact pin is made from brass.

Both contact pins 54 and 62 are inserted into a cavity with their legs in a straightened mode passing through the respective passages. After the pins have been properly positioned in the cavity, the legs are bent down ninety degrees as shown. Housing 22 may now be mounted on board 10 by inserting the legs into the appropriate openings 14. Note that the wings extend below the body section to provide a stand-off. The opening or void between the board and bottom of the body section allows the flow soldering and after-cleaning without interference with the cavity containing section of the housing.

System 20 further includes a second housing 70 also molded from nylon. An integral latch 72 is positioned on either side of housing block 74. The resiliency of the nylon material is sufficient that the fingers 76 can be cammed outwardly by pressing in on arms 78. These fingers cooperate with ears 32 on housing 22 to removably lock the two housings together.

Block 74 contains the same number of through-passageways 80 as are cavities 44 and in the same horizontal spacing. Thus each passageway meets exactly with a cavity when the two housings are locked together. Each passageway has an internal collar 82 located about midway between the front and rear faces 84 and 86 respectively of the block.

As shown in FIG. 2, housing 70 removably retains the conventional terminal 18. Tines 88 and annular ring 90 on the terminal cooperate with internal collar 82 to prevent unintentional withdrawal.

Housing system 20 connects cable 16 with circuits 12 by simply mating the terminals with the contact pins and locking the housings together in the aforestated method. As is well known in the art, the ground current is carried from the shielded braid (not shown) on the coaxial cable through the outer shell 92 on the terminal and to a ground circuit 12 through sleeve 64 and leg 66. The signal is carried from the signal wire (not shown) in the coaxial cable through a center female contact (not shown) in terminal 18 and into an appropriate circuit 12 through contact pin 54.

Figure 3:
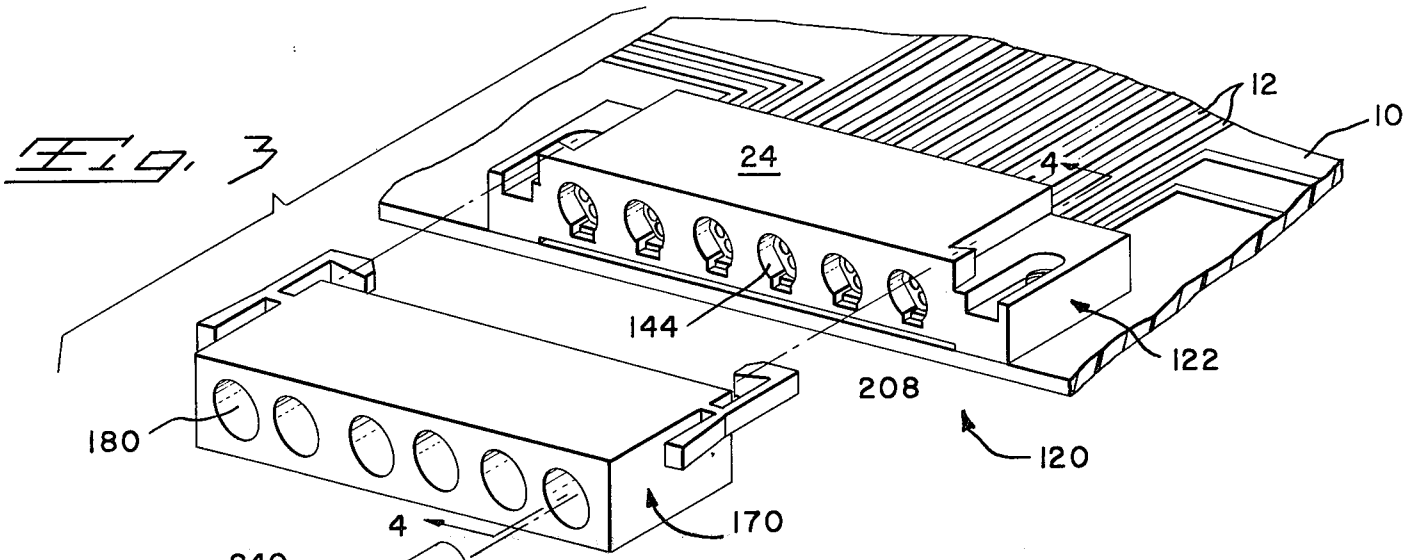
FIG. 3 is a perspective view of another housing system constructed in accordance with the present invention.
Figure 4:
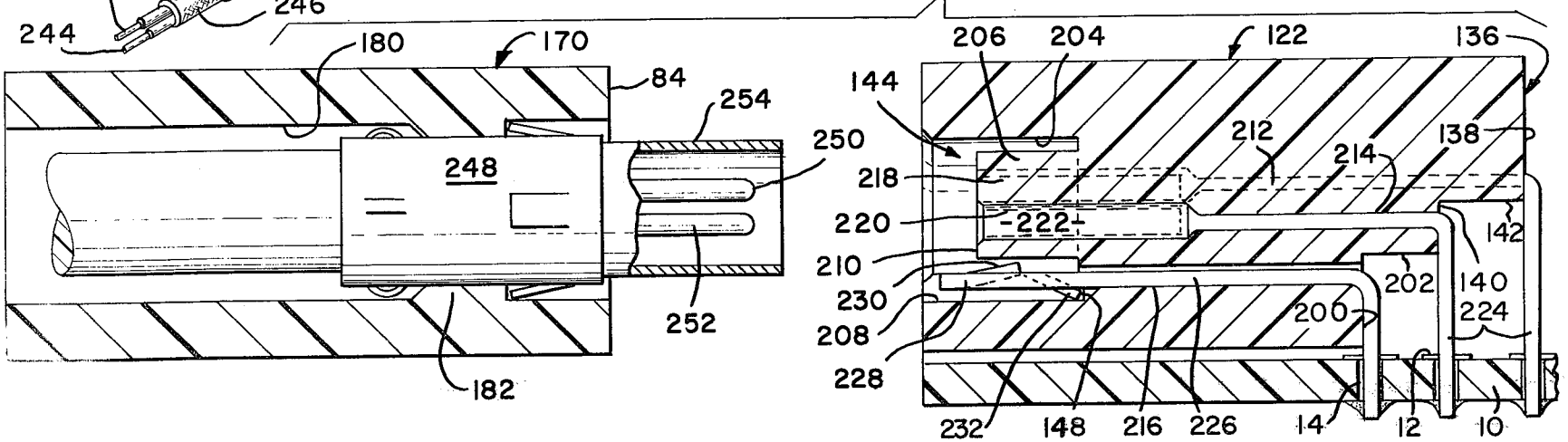
FIG. 4 is an elevational, cross-sectional view of the system taken along lines 4—4 of FIG. 3.

FIGS. 3 and 4 illustrate a housing system designated generally by reference numeral 120. Many of the structural features found in system 120 are the same as in system 20 and will therefore be designated with the same reference numerals when required to provide a full description of system 120. Those parts differing in structural details will be designated with like reference numerals plus 100, i.e., cavities 144. Features original in system 120 will be referenced in the 200 series.

The rear face 136 of first housing 122 consists of first and second vertical walls 138 and 140 respectively and a third vertical wall 200. The three walls define two downwardly facing horizontal walls 142 and 202 respectively.

Each of the several cavities 144 are of moderate depth into body section 24 and shortly merges into an annular, logitudinally extending groove 204. The groove defines an outwardly projecting, annular stub 206. The cavity and groove are not symmetrical. A generally rectangular slot 208 being positioned on the floor of the cavity and extending rearwardly to the same depth as the groove.

Three passages are provided, two having openings on the forward face 210 of stub 206 and one on the rear wall 148 in the vicinity of the slot 208. The first two passages, 212 (shown in phantom) and 214, extend rearwardly to open out on the first and second vertical walls 138 and 140 respectively. The third passage, 216, opens out on the third vertical wall 200.

Two signals contact receptacles 218 and 220 are staked in passages 212 and 214 respectively. Each receptacle consists of a socket member 222 and a leg 224. As with housing 22, the legs are straight until the receptacles are driven into the passages and then the ends extending out of the housing are bent downwardly ninety degrees.

A ground contact pin 226 occupies slot 208 and passage 216. The pin has a rectangular blade 228 with a pair of tines 230 and 232 thereon. The first tine, 230, sticks obliquely upwardly and to the rear. Tine 232 sticks obliquely downwardly and to the rear to abut against the rear wall 148. The free end of leg 234 on pin 226 is also bent downwardly ninety degrees as shown after the pin has been placed in passage 216.

Housing 122 is mounted on a board 10 in the same manner as set forth with respect to housing 22; i.e., legs 224 and 234 are inserted into appropriate openings 14 and flow-soldered or otherwise secured therein.

Second housing 170 contains the same number of through-passageways 180 as are cavities in the first housing 122. Each passageway has an internal collar 182 located close to front face 84.

Housing system 120 has been developed to accommodate a twin coaxial cable 240. This cable contains a pair of signal wires 242 and 244 and a braided shield 246. A conventional twin standard male terminal 248 has a pair of pins 250 and 252 in which are terminated signal wires 242 and 244 respectively. The braided shield is terminated to the outer sleeve member 254. On mating, pins 250 and 252 are received in sockets 222 on receptacles 218 and 220. Sleeve member 254 bears against blade 228.

The foregoing detailed description has been given for clearness of understanding only, and no unnecessary limitations should be understood therefrom, as some modifications will be obvious to those skilled in the art.

What is claimed is:

1. A housing system for connecting a plurality of terminals having a center female receptacle and a cylindrical outer shell to a printed circuit board, which comprises:

a. a first housing of insulating material adapted to be positioned on a printed circuit board, having a plurality of cavities arranged along the front end in a side-by-side relation, a pair of passages extending from each cavity rear wall rearwardly to the back end of the housing, the first passage opening located at the cavity center, and the second passage opening located at the cavity edge, said housing further having latching means thereon;

b. a plurality of signal contact pins of conductive material having a mating section at the forward end and an elongated leg at the other end, said mating section extending into the center of the cavity and the leg extending through the first passage and depending downwardly from the housing for insertion into an opening in the printed circuit board;

c. a plurality of a ground contact pins of conductive material having a sleeve at a forward end and an elongated leg at the other end, said sleeve positioned in the cavity in remote surrounding relation to the signal contact pin mating section and the leg extending through the second passage and depending from the housing for insertion into an opening in the printed circuit board; and d. a second housing of insulating material having latching means thereon adapted to cooperate with the latching means on the first housing so that the two housings can be latched together, further said second housing having a plurality of passageways extending therethrough and arranged in mating alignment with the cavities in the first housing, each passageway having an inwardly extending collar adapted to retain a terminal therein for connecting with the signal contact pins and the ground contact pins in the first housing when the two housings are latched together.

2. The housing system of claim 1 wherein the back end of the first housing includes two vertical walls, one offset horizontally from the other and with the first passage opening being on the upper wall and the second passage opening being on the lower wall.

3. A housing system for connecting a plurality of terminals having a pair of male pins and an outer sleeve member to a printed circuit board, which comprises:

a. a first housing of insulating material adapted to be positioned on a printed circuit board, having a plurality of cavities arranged along the front end in a side-by-side relation, an annular groove extending rearwardly from each cavity to define an annular stub, a slot located along one wall of the cavity and groove and three passages extending from each cavity rearwardly to the back end of the housing, the first and second passages openings located on the face of the annular stub and the third passage opening located adjacent the end of the slot, said housing further having latching means thereon;

b. a plurality of first and second signal contact receptacles of conductive material having a socket member at one end adapted to receive male pins of the terminal, and a leg at another end, said receptacles occupying the first and second passages with the socket members opening forwardly and the legs extending rearwardly through and depending from the housing for insertion into openings in the printed circuit board;

c. a plurality of ground contact pins of conductive material having a blade at one end adapted to contact the outer sleeve member of the terminal and a leg at the other end, said blade being positioned in the slot and the leg extending rearwardly through the third passage and depending from the housing for insertion in the printed circuit board; and d. a second housing of insulating material having latching means thereon adapted to cooperate with the latching means on the first housing so that the two housings can be latched together, further said second housing having a plurality of passageways extending therethrough and arranged in mating alignment with the cavities in the first housing, each passageway having an inwardly extending collar adapted to retain a terminal therein for connecting with the first and second signal contact receptacles and the ground contact pin in the first housing when the two housings are latched together.

4. The housing system of claim 3 wherein the back end of the housing includes three vertical walls, each offset horizontally with respect to the other, and with each of the passages openings being on a different vertical wall.

* * * * *